US005507255A

United States Patent [19]

Boisvert et al.

[11] Patent Number: 5,507,255

[45] **Date of Patent: *Apr. 16, 1996**

[54] GLOW PLUG CONTROLLER

[75] Inventors: Mario P. Boisvert; Thomas P. Kienitz; Marty M. Zoerner, all of Reed City, Mich.

[73] Assignee: Nartron Corporation, Reed City, Mich.

[ * ] Notice: The term of this patent shall not extend beyond the expiration date of Pat. No. 5,327,870.

[21] Appl. No.: 210,247

[22] Filed: Mar. 17, 1994

Related U.S. Application Data

[63] Continuation of Ser. No. 112,651, Aug. 26, 1993, Pat. No. 5,327,870, which is a continuation of Ser. No. 785,462, Oct. 31, 1991, abandoned.

[51] Int. Cl.[6] ..... F02P 19/02

[52] U.S. Cl. ..... 123/145 A

[58] Field of Search ..... 123/145 A, 179.6, 123/179.21; 361/264, 265, 752, 757

[56] References Cited

U.S. PATENT DOCUMENTS

| | | | |
|---|---|---|---|
| 4,002,924 | 1/1977 | Busch | 361/399 |
| 4,196,467 | 4/1980 | Jakob et al. | 361/399 |
| 4,300,491 | 11/1981 | Hara et al. | 123/179.6 |
| 4,573,105 | 2/1986 | Beldavs | 361/768 |
| 4,600,969 | 7/1986 | Hendrickson | 361/399 |

*Primary Examiner*—Andrew M. Dolinar
*Attorney, Agent, or Firm*—Watts, Hoffmann, Fisher & Heinke Co.

[57] ABSTRACT

An improved glow plug controller for a diesel engine is disclosed. The glow plug controller has a novel packaging, and means for facilitating rapid and inexpensive assembly. A novel two-chamber tubular housing includes a smaller first chamber having a threaded exterior surface for engagement with a threaded hole in an engine block. This first chamber communicates with a larger second chamber also defined by the housing. A connector bearing conductive connector pins is provided for sealing the open end of the larger chamber. The connector includes a pair of support rails for engaging a piece of circuit board on which glow plug circuitry resides. In assembly, the circuit board is first mounted on the support rails which are subsequently inserted into the larger second chamber when the connector is affixed to the open end of the second chamber. The connector pins are conductively coupled to glow plug circuitry on the circuit board via portions of conductive foil on a surface of the circuit board. Each area of foil is aligned with a respective one of the connector pins, and the connector pins are directly conductively coupled to the foil areas by soldering. A unique short circuit cutoff is provided wherein a short circuit in the glow plug relay control disables application of power to the relay control circuit, and the power is re-enabled if the short circuit condition is remedied and the power to the glow plug controller is toggled.

8 Claims, 8 Drawing Sheets

GLOW PLUG CONTROLLER

This is a continuation of application Ser. No. 08/112,651, filed Aug. 26, 1993, now U.S. Pat. No. 5,327,870, which is a continuation of application Ser. No. 07/785,462, filed Oct. 31, 1991, now abandoned.

FIELD OF THE INVENTION

This invention relates generally to the field of diesel powered vehicles, and more particularly to improved controller circuitry, and mounting and housing structure therefor, for governing operation of the glow plugs of the engine of such a vehicle.

BACKGROUND ART

The present invention is intended for use in an environment of a self-propelled vehicle or other piece of equipment which is powered by a known form of internal combustion engine. The invention is preferably designed for use in connection with a vehicle or other equipment powered by a diesel engine.

Diesel engines do not use spark plugs. Rather, they rely for ignition of the fuel-air mixture on compression of that mixture by rapid motion of a piston to reduce the volume of a fuel-air charge in the combustion chamber.

When a diesel engine is started, however, known glow plugs are used to assist in providing engine starting ignition. The glow plugs typically are operated for a brief time.

Vehicles of the type forming the environment for the present invention are commonly heavy-duty military and commercial vehicles such as trucks, buses, infantry fighting vehicles, tanks, and others. Because such vehicles are typically operated by a large number of operators having different skill levels, considerable warning and protection equipment is incorporated into such vehicles. This warning and protection equipment includes means for informing an operator of the operations and conditions of certain vehicle and engine components.

The glow plugs of diesel engines are commonly controlled by a glow plug controller circuit. The glow plug controller circuit, upon an operator turning on the ignition, applies a high DC current, often in the neighborhood of 150 amps, to the glow plugs continuously during what is known as a "pre-glow" mode. A sensor detects the temperature of the engine and controls the pre-glow mode which endures for a period of time, typically 3–8 seconds. Following the pre-glow portion of the cycle, the glow plug controller shifts to an "afterglow" portion of the cycle. During the afterglow portion, the glow plugs are continued in pulsed operation, until the sensor detects that the ambient engine temperature has risen to a predetermined level, after which the glow plugs are turned off. Sometimes, during the afterglow cycle, the duty cycle of the glow plugs is adjusted, the duty cycle being reduced as the ambient engine temperature rises prior to glow plug cut-off.

FIG. 1 is a partially schematic, partially block diagram illustrating some of the electrical components of a diesel engine and associated peripheral equipment which form the environment for the present invention. The items illustrated in FIG. 1 do not form part of the present invention per se, but rather are known components in connection with which the present invention, described in detail in succeeding sections, operates. The components illustrated in FIG. 1 are all known and within the skill of one ordinarily conversant with the relevant art. FIG. 1, and this description, is provided for the benefit of those not intimately familiar with this art. FIG. 1 is not intended as a detailed schematic description of these known components. Rather, FIG. 1 is intended only for a general understanding of the relationship among these components.

Toward the left-hand portion of FIG. 1 is a column of eight glow plugs, the uppermost of which is indicated by the reference character G. Operation of the glow plugs is governed by a glow plug controller indicated as GPC. An electric starter motor M, with associated switching, is provided for starting the engine. Batteries B are provided for selectively actuating the starter motor M, and for providing DC electrical power for operating other electrical components of the vehicle and for peripheral components of the engine as needed. The vehicle batteries provide 24 volts DC. The vehicle operates, while running, at 28 volts. Preferably, two batteries in series are provided.

A run/start switch RS is provided for actuating the vehicle ignition circuitry and for selectively actuating the starter.

An alternator A, driven by the engine, provides electrical power for charging the batteries B for providing electrical power to the vehicles loads. The alternator A has an "R tap," (connected to the field) indicated by reference character R.

A fuel solenoid F governs flow of fuel to the engine.

A clutch control C electrically engages and disengages an electric motor driven engine cooling fan.

A wait-to-start lamp W provides a visual indication to an operator when the pre-glow cycle is occurring and it would thus be inappropriate to try to start the diesel engine. A brake warning lamp BW indicates to the operator when a parking brake is set. The brake warning lamp BW also indicates when the start solenoid is engaged. A brake pressure switch BP provides an indication to the operator when a predetermined amount of force is applied to the service brake pedal. A park brake switch PB, indicates by means of the lamp that the vehicle parking brake is set.

The electrical system of the engine operates several types of electrical loads. One such load is a heater motor indicated generally at the reference character H. Lighting loads are connected to a lead generally indicated by the reference character LL. Certain miscellaneous electrical vehicle loads are indicated by the resistor at reference character VL.

The present invention, as will be described in detail, includes improved circuitry and sub-circuits for governing and safe-guarding operation of the known components illustrated in FIG. 1. Interfaces for connecting the known components of FIG. 1 are provided by an engine connector C1 and a body connector C2, both illustrated in FIG. 1. These connectors interface between the inventive circuitry (not shown in FIG. 1) and the engine and vehicle components shown in FIG. 1.

The concept of controlling glow plugs with solid state controller devices including clocking circuits regulating such functions as glow plug preheat and afterglow control, as well as control of the duty cycle of glow plugs, and temperature related control, is well known. For example, Arnold et al., U.S. Pat. No. 4,882,370, shows a solid state microprocessor controlled device for regulating many aspects of glow plug performance. The Arnold circuitry adjusts the duty cycle of glow plugs as a function of temperature, regulates pre-glow function, and detects undesirable short circuits and open circuits for implementing a disable function. U.S. Pat. No. 4,300,491, to Hara et al., achieves a variable time control of the pre-glow period by means of a plurality of transistors and diodes. Van Ostrom, U.S. Pat. No. 4,137,885 describes means for cyclicly interrupting a glow plug energizing circuit when a maximum temperature is reached. Cooper, U.S. Pat. No. 4,312,307 describes circuitry for control of the duty cycle of glow plugs by means of heat-sensitive switches. Each of the above-identified United States patents listed in this paragraph are hereby expressly incorporated by reference.

It is a general object of the present invention to provide improved glow plug controller circuitry, and mounting and housing structure for such a glow plug controller, to enhance the precision and efficacy of control of operation of the glow plugs of a diesel engine, and to enhance the durability, reliability and ease of assembly of the glow plug controller.

DESCRIPTION OF THE INVENTION

The disadvantages of the prior art are eliminated or reduced by a glow plug controller having a particularly advantageous housing package, and which can be made by a relatively simple and inexpensive assembly process.

One aspect of the invention involves a glow plug controller having a generally tubular housing with a wall defining first and second chambers communicating with one another. The first chamber is smaller in volume than the second chamber. The exterior of the first chamber is threaded to accommodate its engagement with a threaded hole in an engine block. Glow plug controller circuitry including a temperature sensor is located within the housing. The temperature sensor itself is located within the smaller first chamber, while other glow plug circuitry is located in the larger second chamber. Connector pins extend through the housing coupling the glow plug control circuitry to other circuitry external to the housing.

In a more specific embodiment, the temperature sensor is a thermistor, and the housing is filled with potting compound having a relatively high thermal conductivity.

This arrangement provides for the temperature sensor to be closely thermally coupled to the engine coolant, so that the temperature sensor provides a highly accurate representation of engine coolant temperature, in response to which the glow plug controller circuitry governs some aspects of glow plug operation.

In another specific aspect, the outer surface of the wall defining the larger, or second, chamber includes a region having generally hexagonal cross-section for facilitation engagement of the housing by a tool, in order to readily tighten the housing into the threaded hole in the engine block.

In another specific aspect, the glow plug circuitry comprises printed circuit board. More specifically, the glow plug controller circuitry is borne on two separate circuit boards which are coupled together by a flexible ribbon cable, rendering an articulated structure. In assembly, one of the circuit boards is folded over the other, such that the circuit boards form a generally parallel, closely stacked arrangement.

In a more specific embodiment, one of the circuit boards defines a major portion which is adapted to fit within the larger second chamber, and also has a protrusion which is small enough to fit within the smaller first chamber. The protrusion carries the temperature sensor. In assembly, the circuit board is fitted within the second chamber, with the protrusion extending further, into the first chamber.

In another specific embodiment, the glow plug controller packaging also includes a shell member adapted for engaging an open end of the housing in order to form a cover. Conductive connector pins extend from respective locations within the housing out through the shell member to respective locations external to the housing.

The shell member carries two diametrically opposed U-shaped support channel rails which extend into the second chamber when the shell member is affixed to cover the end of the housing. The U-shaped channel rails are adapted for engaging opposite edges of a piece of circuit board material.

This arrangement simplifies glow plug controller assembly. When it is desired to insert the glow plug controller circuitry into the second chamber of the housing, the circuit board on which the glow plug controller circuitry resides is first mounted in the U-shaped channel rails of the shell member, prior to affixing the shell member to cover the open end of the housing. The circuit board, so mounted on the shell member, rides neatly into the housing when the shell member is affixed to cover the end of the housing. After assembly, the circuit board remains rigidly held within the second chamber by the U-shaped channel rails.

In another specific embodiment, the printed circuit board on which the glow plug controller circuitry resides includes several separate conductive foil layers on its surface, each portion of conductive foil being closely aligned with a respective one of the connector pins described above. The foil portions are each conductively connected to a portion of the glow plug controller circuitry. The respective foil layer portions can be directly conductively connected to their respectively aligned connector pins by nothing more than soldering. This results in an electrical arrangement which is simpler and less costly than if other types of intermediate conductors and/or connectors were required to conductively couple the glow plug controller circuitry to the respective connector pins.

In another specific aspect, a glow plug controller is provided having means for detecting a short circuit in the associated glow plug relay circuitry, and for disabling the application of power to the glow plug relay in response to the detection of such a short circuit. More specifically, the disabling means includes means for re-enabling application of power to the glow plug control circuitry when the short circuit condition has been remedied and the power to the glow plug controller has been toggled OFF and then ON.

According to another specific aspect, the glow plug controller circuitry includes capacitive impedance, which is provided by capacitor multiplier circuitry, resulting in a saving of weight and bulk.

This invention will be understood in more detail by reference to the following detailed description, and to the drawings, in which:

BEST MODE FOR CARRYING OUT THE INVENTION

General Operational Description

The glow plug controller of the present invention governs many aspects of glow plug operation. It controls the application of power to glow plugs independent of vehicle battery voltage. For example, the glow plug controller applies power to the glow plugs as a function of engine coolant temperature. The glow plug controller also provides for an afterglow mode, which is desirable for enhancing idling smoothness and reducing smoke in the engine exhaust.

The glow plug controller includes a temperature sensor, a variety of electronic circuitry and electrical connector circuitry integrated in a housing for the glow plug controller. The glow plug controller is preferably environmentally sealed. The glow plug controller is of primarily solid state design. These features facilitate the provision of a rugged, dependable unit requiring, in most instances, no calibration at all after manufacture.

Figure 1:
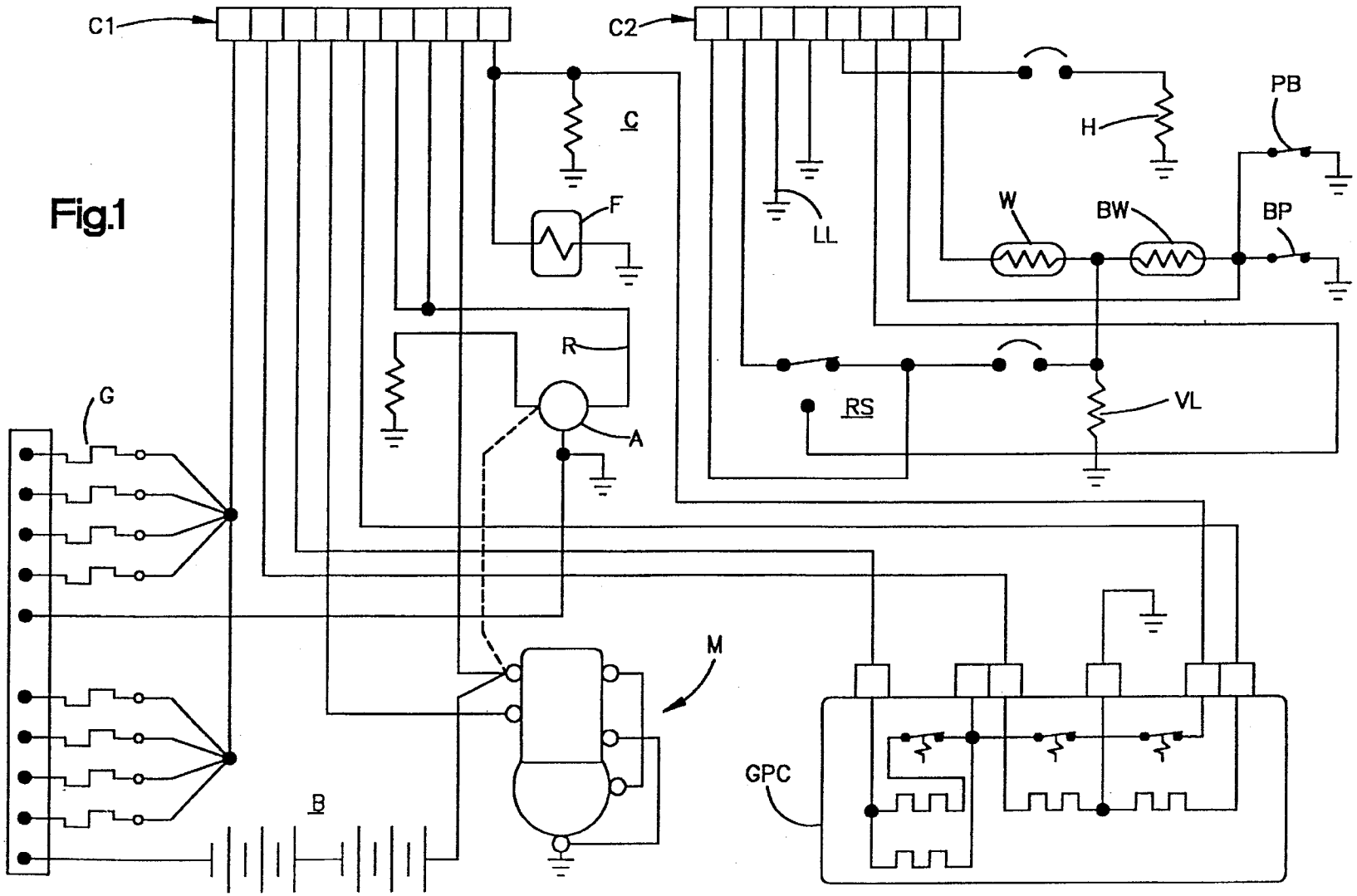
FIG. 1 is a partially schematic, partially block diagram illustrating a portion of the environment in which the present invention is incorporated.
Figure 2:
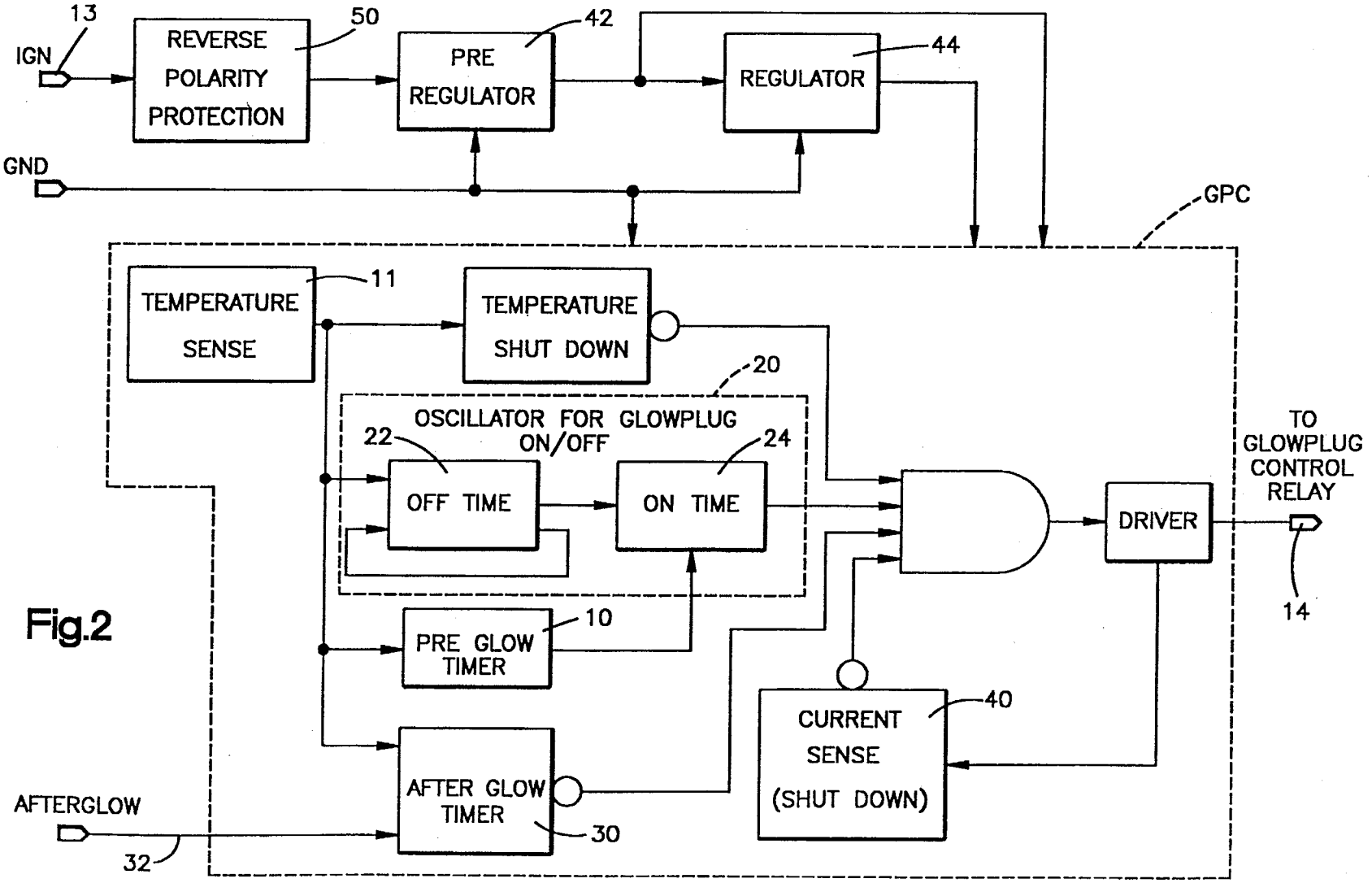
FIG. 2 is a block diagram illustrating in functional form circuitry incorporated into an embodiment of the present invention.

FIG. 2 is a functional block diagram illustrating the electrical operation of the glow plug controller. In FIGS. 1 and 2, the glow plug controller is indicated generally by the reference characters GPC.

The Preglow Timer 10

Preglow is the initial time period during which the glow plugs must be powered to heat the glow plugs to a predetermined temperature which is a function of sensed coolant temperature, represented by a signal from a sensor 11. The preglow timer 10 is activated by the application of power to the glow plug controller GPC, at ignition terminal 13.

After the glow plugs have been heated to a predetermined temperature under the preglow condition, the temperature of the glow plugs is then maintained by a cycling afterglow timer 20, including an off timer 22 and an on timer 24. The cycling timer 20 cycles power application to the glow plugs ON and OFF. Both the OFF time and the cycling frequency of the glow plugs are adjusted as a function of the temperature of the system.

The glow plugs will continue to cycle until both a signal is received from the alternator R-tap, on a lead 32, which indicates engine start, and the glow plug controller times out. At this point, an output signal from the glow plug controller at a lead 14 will shut off. This cessation of the output signal causes a glow plug relay, (see terminal 12) external to the glow plug controller, to drop out and remove power from the glow plugs.

An afterglow timer 30 begins an afterglow time period when a signal is received from the alternator which indicates either that the engine is cranking, or has already started. The afterglow period is a declining function of ambient temperature.

The glow plug controller includes a fault detection circuit 40 for detecting a short circuit to ground on the glow plug controller output which drives the external glow plug relay mentioned above. If such a system fault condition occurs, the glow plug controller will shut down until the short circuit condition is removed. The glow plug controller will function without any adverse effects after the short circuit condition is removed.

Figure 5:
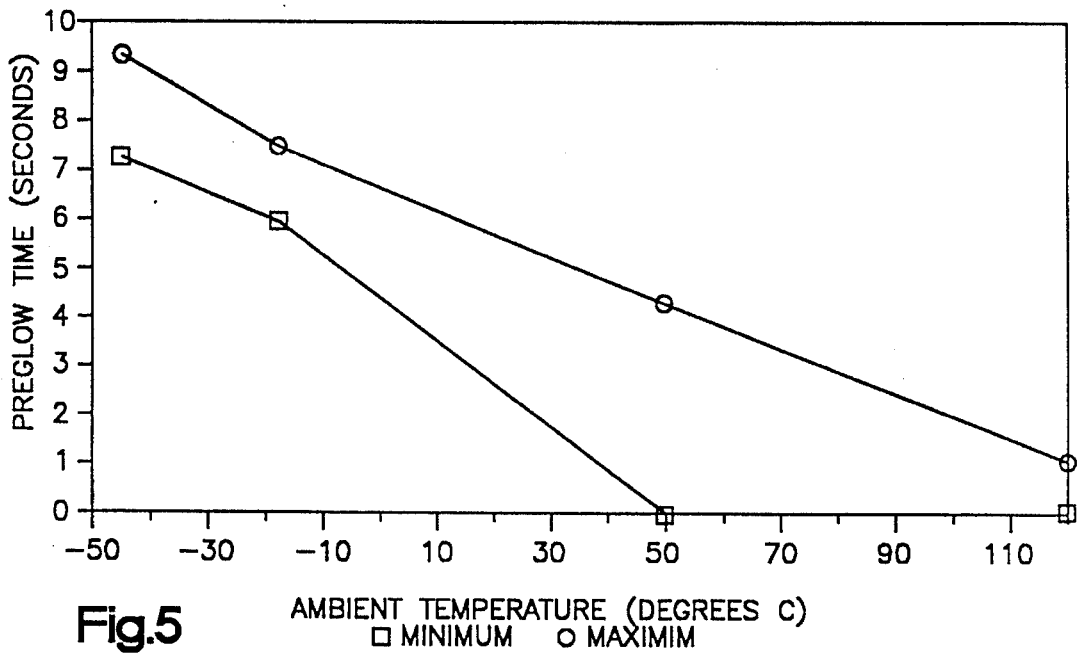
FIGS. 5–8 are graphs representing ranges of preferred operating characteristics for the present invention.
Figure 6:
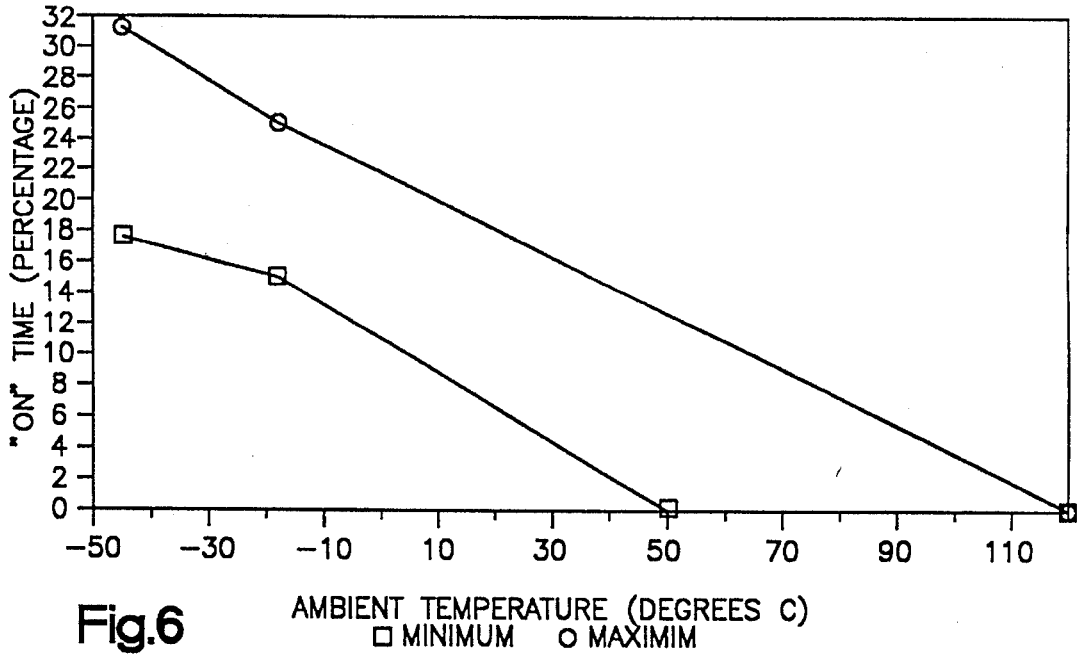
Figure 7:
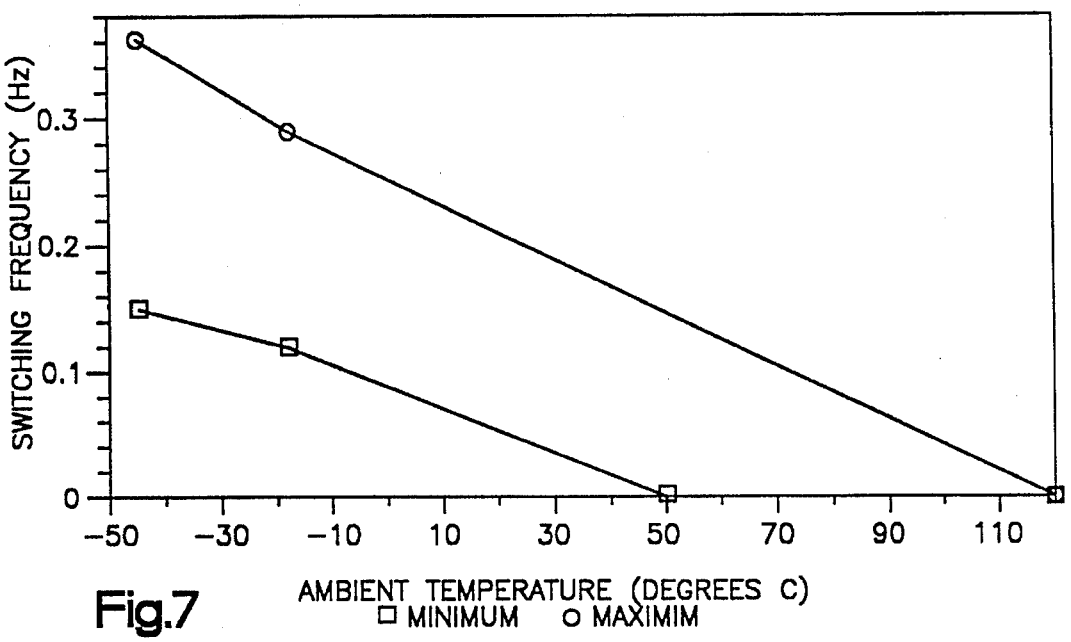
Figure 8:
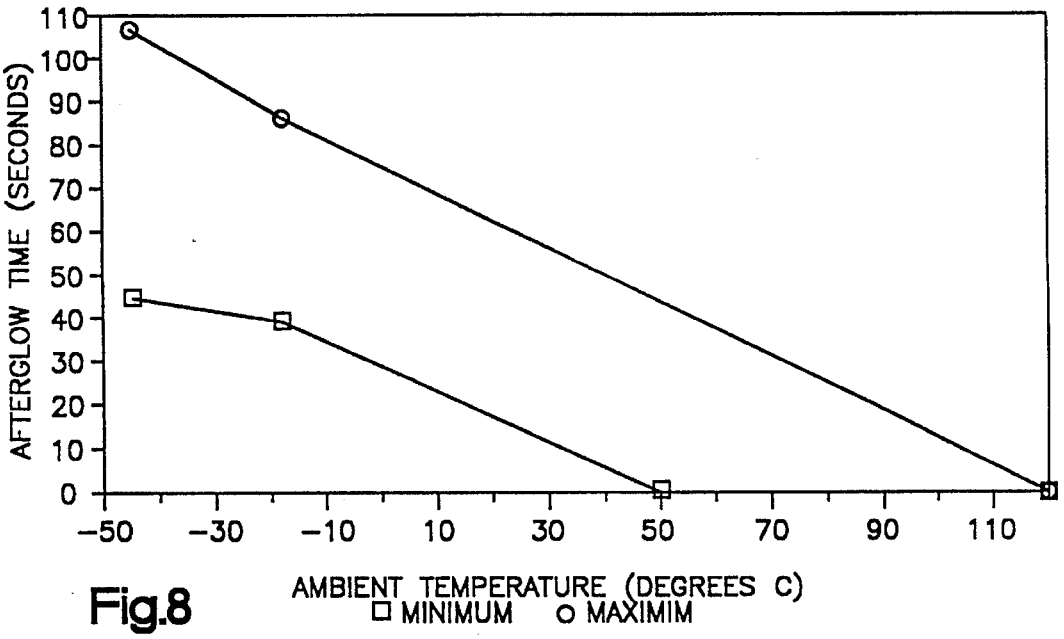

FIG. 5 is a graph showing preglow time vs. ambient temperature over the supply range. FIG. 6 indicates the percent of "ON" time of a duty cycle vs. ambient temperature over a supply voltage range. FIG. 7 shows switching frequency vs. ambient temperature over a supply voltage range. FIG. 8 shows afterglow time vs. ambient temperature over a supply voltage range.

The glow plug controller is designed to operate with a supply voltage of anywhere between 16 and 30 volts and over a temperature range of −45 to +120 degrees celsius. This is accomplished by a pre-regulator 42 and a regulator 44. Once activated, the glow plug controller will continue to operate even if the supply voltage then drops as low as to 9 volts, such as might occur during engine cranking when there is a heavy drain on the vehicle battery.

The glow plug controller is also protected by circuitry 50 against the inadvertent application of reverse voltage, such as might occur if an operator or maintenance individual connected the battery terminals backwards. As such, the glow plug controller is protected against a reverse application of −30 volts to its supply terminals for 60 seconds.

The glow plug controller circuit includes 8 operational sub-circuits: power supply 100; alternator circuit 120; afterglow timer 130; temperature shut-down circuit 140; preglow timer 150; time off circuit 160; time on circuit 170, and current shut-off circuit 180.

Figure 3A:
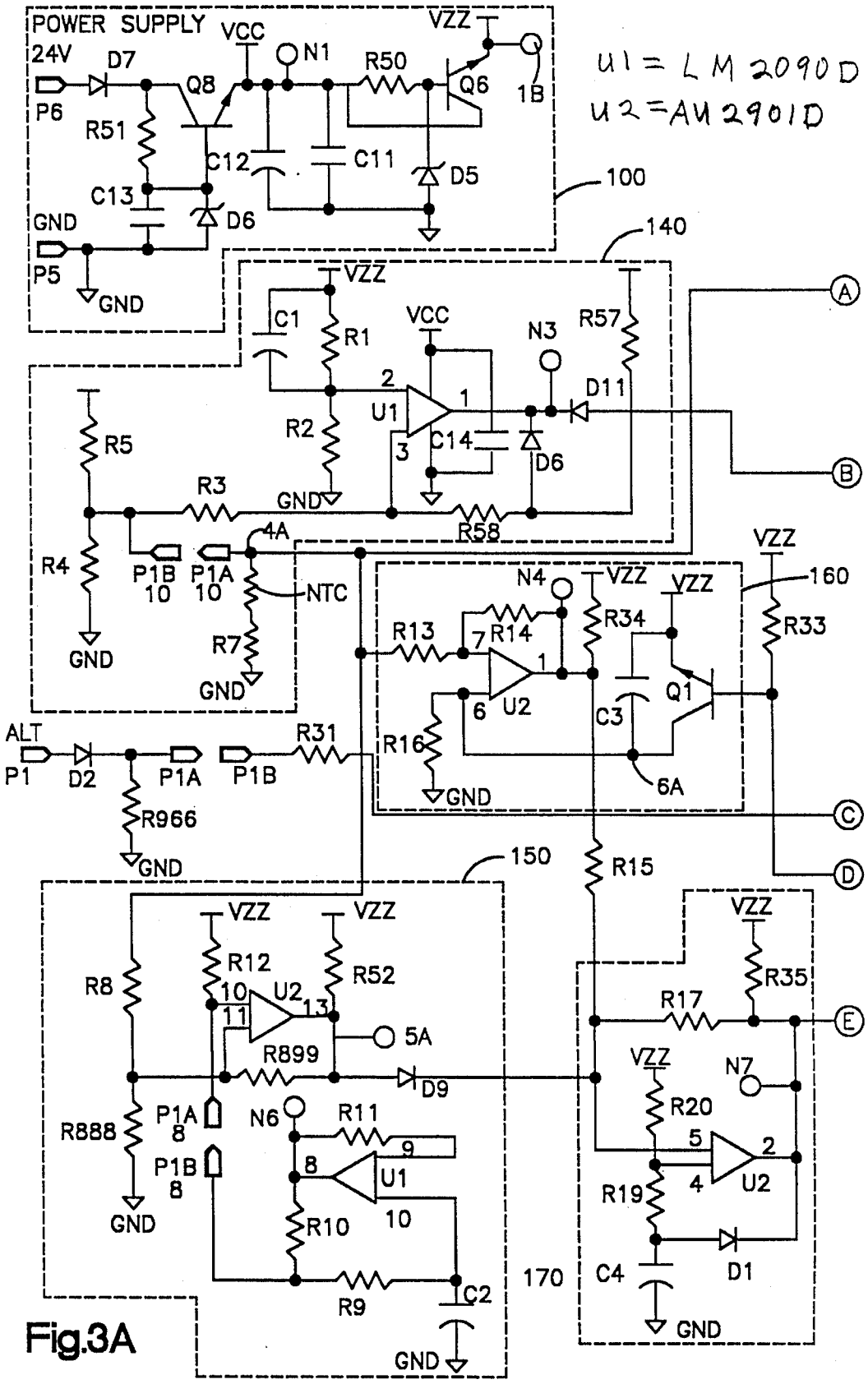
FIGS. 3*a*, 3*b* and 3*c* are schematic drawings illustrating in detail circuitry represented in block form in FIG. 2.
Figure 3B:
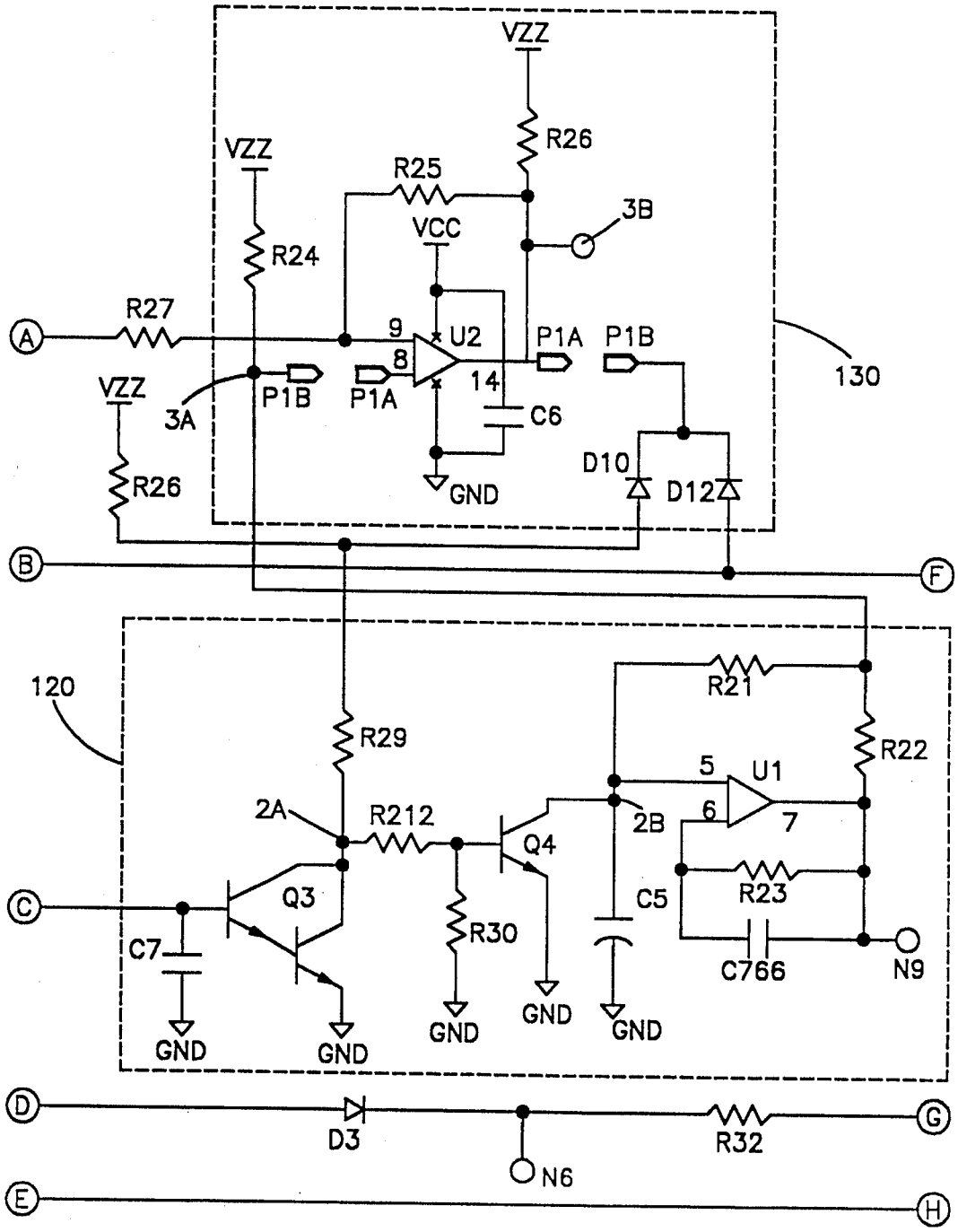
Figure 3B:
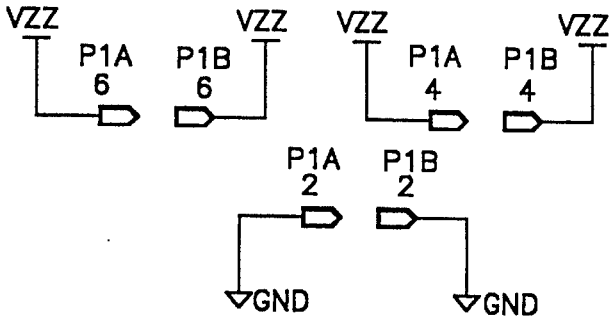
Figure 3C:
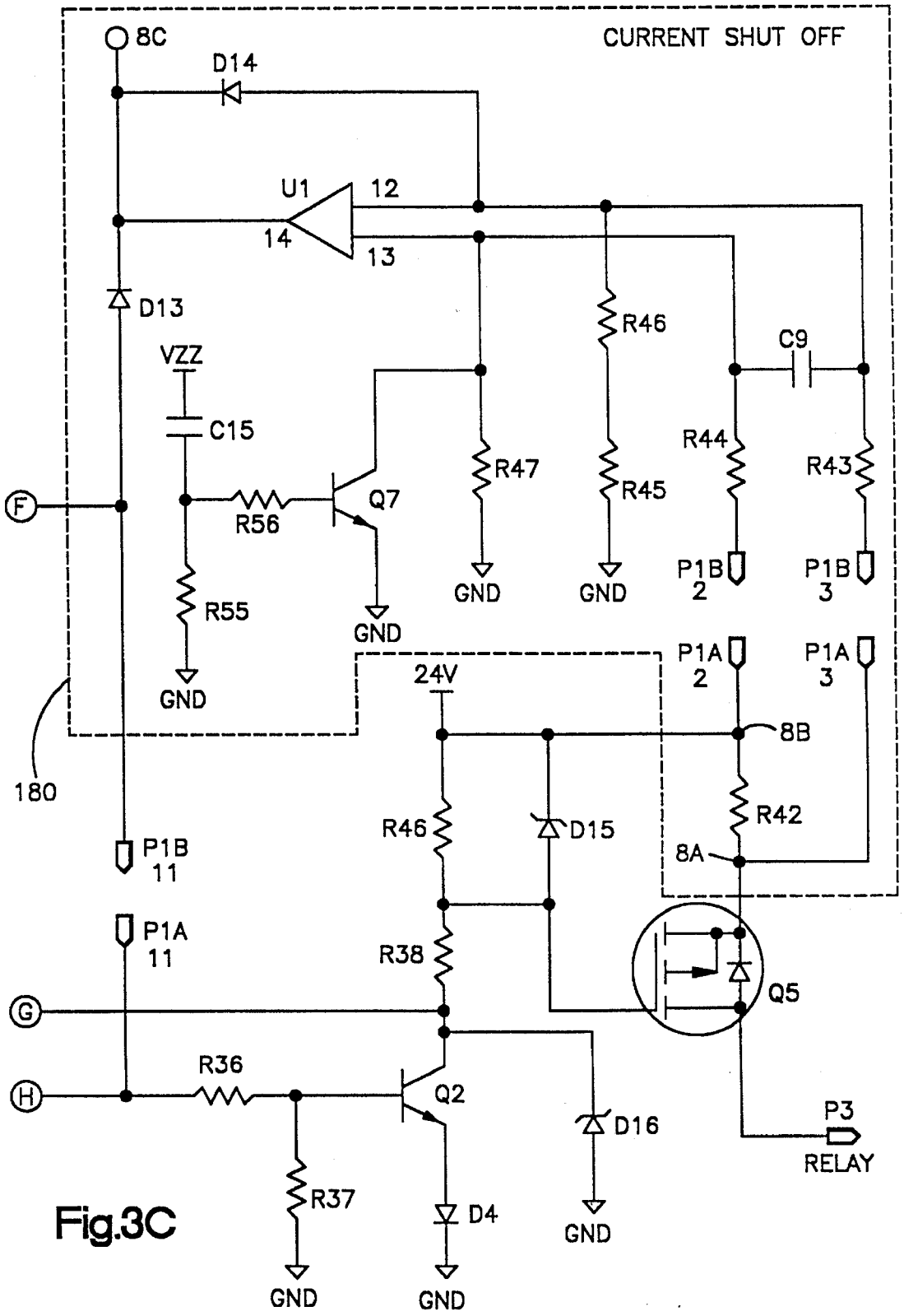

Each of these sub-circuits will be described with reference to FIGS. 3*a*, 3*b* and 3*c* which are electrical schematic diagrams showing the circuitry broken into three portions, the connecting lines between portions being indicated by circled capitol letters A–H.

Power Supply Sub-Circuit 100

An operational input voltage appearing at a terminal P6 varies, depending on vehicle operating conditions, between 16 volts and 30 volts. A 27 volt zener diode D6 holds a transistor Q8 in its ON condition, producing a voltage at a node N1 of an IC (integrated circuit) power supply Vcc. A 6.8 volt zener diode D5 holds a transistor Q6 in its ON state by applying a constant 6.8 volts to the base of the transistor Q6. A constant supply voltage Vzz appearing at a node 1B is at a potential which is a diode drop less than the 6.8 volts appearing at the base of the transistor Q6. A diode D7 protects the circuit from reverse voltages and the diode D6 protects, the circuit from transients and over-voltages.

Alternator Sub-Circuit 120

The alternator circuit flows through an RC branch, which includes a diode D2, a resistor R31, a resistor R966 and a capacitor C7. While the capacitor C7 charges to a high enough voltage to turn a transistor Q3 to its ON condition, the collector of the transistor Q3 remains high. This high voltage, appearing at a node 2A, turns a transistor Q4 to its ON condition. This discharges a capacitor C5. When the capacitor C7 charges to greater than 1.5 volts, the transistor Q3 is turned to its ON state, and pulls the node 2A to ground., This turns the transistor Q4 to its OFF state. At this point, the capacitor C5 at the node 2B starts to charge through a resistor R21, increasing the voltage at a pin 7 of an operational amplifier designated by the reference character U1.

After Glow Timer Sub-Circuit 130

As the voltage at the pin 7 of the alternator sub-circuit increases the voltage at a node 3A also increases. The voltage reference at the pin 9 of a comparator U2 is determined by a voltage divider consisting of resistors R5 and R4 in parallel with a resistor R7 and a temperature sensitive NTC, and by the gain of the comparator U2. When the voltage at the node 3A is large enough in relation to the reference voltage at the pin 9, the output at a node 3B, pin 14 of the comparator U2, is pulled to ground. This turns off the glow plug drive relay and disables the alternator sub-circuit 120 by way of two diodes D12 and D10, respectively.

Temperature Shutdown Sub-Circuit 140

The temperature shutdown sub-circuit is designed to shut down the glow plug relay once the ambient system temperature reaches approximately 50° Celsius. As the ambient temperature increases, the voltage at a node 4A decreases. If the voltage at the node 4A decreases below the voltage reference established by a voltage divider consisting of resistors R1 and R2, at pin 2 of the operational amplifier U1, the output at a pin 1 of the operational amplifier U1 is pulled to ground. This allows a diode D11 to turn off the glow plug relay by pulling a resistor R36, at the base of a transistor Q2, low. The glow plug relay will remain off until the temperature falls below 40° Celsius.

The Preglow Timer Sub-Circuit 150

The preglow timer sub-circuit 150 turns on the glow plugs continuously for a specific duration of time prior to the initiation of cycling of pulsed power application to the glow plugs. The length of the preglow time is determined by the ambient system temperature via the NTC sensor coupled to the node 4A. Initially, the output at a pin 13 of a node 5A is high, enabling a diode D9 to turn the transistor Q2 to its ON condition. This drives the glow plug relay, i.e., places it in its closed, or operative condition, facilitating transmission of power to the glow plugs. At the same time, a capacitor multiplier circuit including a capacitor C2, charges through the resistor R9 and a resistor R12. This increases the voltage at a pin 10 of the comparator U2. From power up of the glow plug controller until the time at which the voltage at the pin 10 reaches the NTC-determined reference voltage, the glow plugs remain in their ON condition, with power being continuously applied. This period of time defines the preglow function.

Once the voltage at the pin 10 reaches the reference voltage determined by the temperature sensitive NTC, the output of the comparator U2, appearing at its pin 13, goes low. This turns OFF the transistor Q2. This in turn terminates continuous power application and initiates application of power to the glow plugs in a cyclical fashion, i.e., in a pulsed, or toggling, fashion. Thus, the afterglow function is begun.

The Timer Off Sub-Circuit 160

The time off sub-circuit 160 determines the portion of time that power will not be applied to the glow plugs during each period of an OFF/ON glow plug power application cycle, i.e., the afterglow. When the preglow timer sub-circuit times out, as described above, the collector of the transistor Q2 goes high. This turns off a transistor Q1. The voltage at a node 6A starts to decrease as a capacitor C3 discharges through a resistor R16. The output at pin 1 of the comparator U2 remains low. This maintains the transistor Q2 in its OFF condition. When the voltage at the node 6A reaches the voltage reference established by the ambient system temperature via the NTC, the output at the pin 1 of the comparator U2 goes high. This in turn starts the "time on" portion of the cycle. The length of the time off is determined by the time interval between the time when the transistor Q1 turns off, and when pin 1 of the comparator U2 goes high. It can be seen from the above discussion that the length of the OFF portion of the power application cycle varies as an increasing function of the sensed ambient temperature.

The Time on Sub-Circuit 170

The time on sub-circuit 170 determines the portion of time during which power will be applied to the glow plugs during the glow plug ON/OFF cycling afterglow function. When the pin 1 of the comparator U2 goes high at the end of the time OFF portion of the cycle, a positive input (+) of the comparator U2 will be biased higher than the reference input (–) of the comparator U2. This causes the output of the comparator U2 to go high. Once the output of the comparator U2 has assumed its high condition, a capacitor C4 will begin to charge. This increases the voltage at the reference input (–). Until this voltage becomes higher than the bias at the input (+), appearing at pin 5 of the comparator U2, the output of the comparator U2, at pin 2, will remain high. A high voltage at comparator pin 2 holds the transistor Q2 in its ON condition. This enables the glow plug relay, placing it in its closed, or operative condition, in which it supplies power to the glow plugs. When the capacitor C4 charges to a voltage level high enough to make the voltage at the pin 4 of the comparator U2 equal to the reference voltage at the pin 5 of the comparator U2, the output at pin 2 of the comparator U2 will go low, thus turning off the transistor Q2, which in turn shuts off the glow plug relay.

Unlike the "time off" period, the "time on" period is not temperature dependent.

The Current Shut-Off Sub-Circuit 180

The current shut-off sub-circuit 180 is designed to shut off a field effect transistor Q5 when the glow plug relay is shorted out. The voltage across a current sensing resistor R42 is used to detect a short circuit condition. A node 8B of the current sensing resistor R42 is tied directly to a source of 24 volts and is used as a voltage reference, via a voltage divider including resistors R47 and R44 at a pin 13 of the operational amplifier U1. A node 8A of the current sensing resistor is tied directly to the drain of the field effect transistor Q5 and is normally slightly lower than 24 volts and is used as an input voltage via a voltage divider including resistors R43, R46 and R45 at a pin 12 of the operational amplifier U1.

Normally, the voltage at the pin 12 is greater than the voltage appearing at the pin 13 which causes a node 8C at an output pin 14 of the operational amplifier U1 to be high. When a short circuit condition occurs in the glow plugs, the voltage at the node 8A goes to ground, causing the output at the node 8C to go to ground as well. A diode D13 pulls the base of the transistor Q2 OFF, which in turn shuts off the field effect transistor Q5, disabling the shorted load. A diode D14 latches the output at the node 8C, maintaining the field effect transistor Q5 in its OFF condition until power is cycled, or toggled. A transistor Q7 is intended to bring the pin 13 to ground during inrush to prevent the output of the operational amplifier U1 from going low. After inrush, the base of the transistor Q7 is held low by a pulldown resistor R55.

General Mechanical and Physical Features

The glow plug controller is mounted to the engine by means of a threaded connection on its housing. The circuitry of the glow plug controller is contained within a housing which is preferably made of aluminum.

Figure 4B:
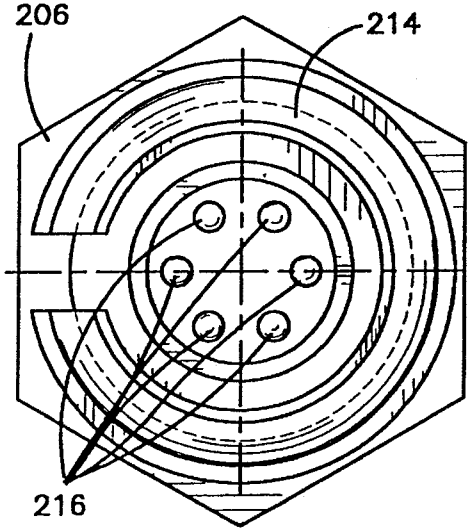
FIGS. 4*a* and 4*b* are an elevational side partially in section view, and an end view, respectively, illustrating a housing assembly for the circuitry of the present invention.
Figure 4A:
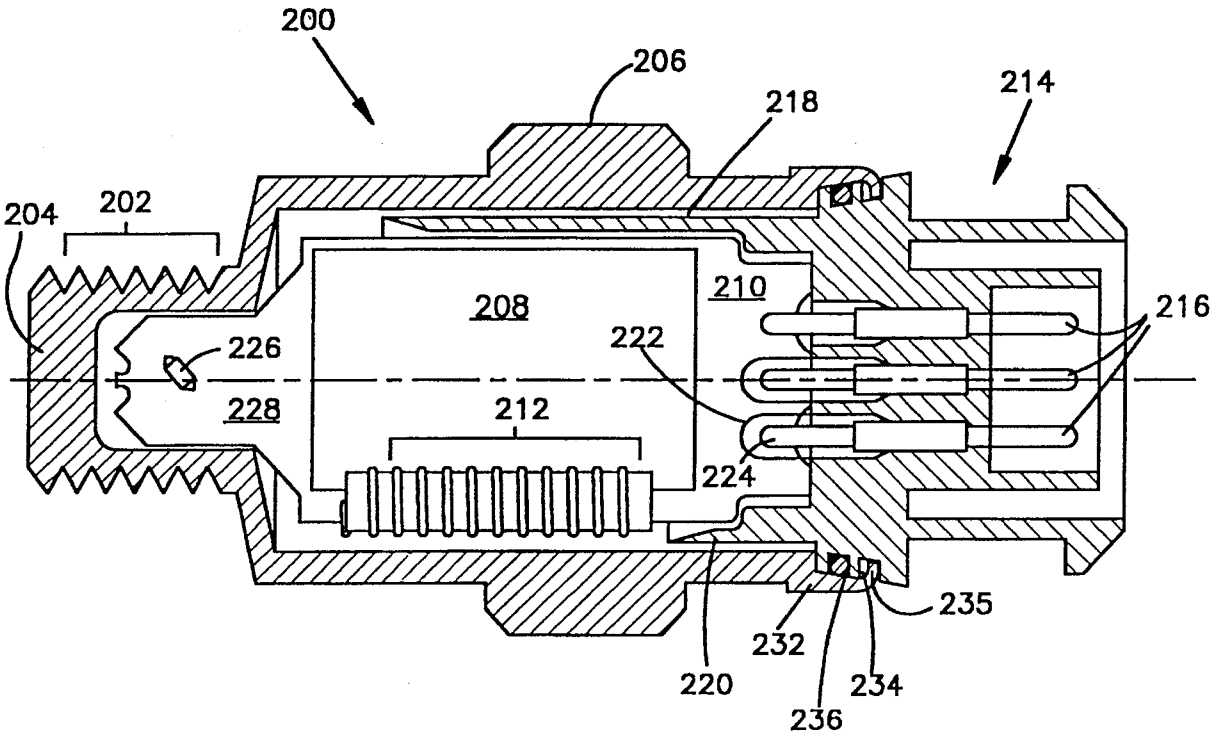

The mechanical configuration of the glow plug controller is illustrated in FIGS. 4*a* and 4*b*. A cylindrical aluminum housing 200 has a threaded portion 202 near its left end, as shown in FIG. 4*a*. The threaded portion is hollow, but is sealed at 204 on its left hand end. A portion 206 of the cylinder is hexagonal in cross-section.

In use, the glow plug controller, including a thermistor temperature sensor, is mounted in a threaded hole (not shown) in the engine block of the vehicle, near a portion of the water jacket of the engine. The hexagonal portion facilitates tightening of the housing containing the glow plug controller circuitry into the engine block by use of an appropriate tool. The hole (not shown) can actually penetrate the block, such that the end 204 of the housing is directly exposed to engine coolant.

The controller comprises smaller and larger printed circuit boards 208, 210, respectively. The circuit boards are interconnected via a ribbon cable 212.

A generally cylindrical connector 214 defines a set of integral connector pins 216. The cylindrical connector is molded of a suitable plastic material. The connector defines two u-channel rails 218, 220 which are diametrically opposed. The channel rails 218,220 are. positioned to engage the edges of the circuit board 210.

The circuit board 210 has foil layer areas 222, which are conductively connected to appropriate portions of the circuitry carried on the circuit board 210. The foil areas 222 are aligned to lie adjacent the distal ends 224 of the connector pins 216.

In assembly, the circuit board 210 is mounted by engagement of its edges between the u-channel rails. The channel rails hold the circuit board in a location wherein the respective foil areas are each near an appropriate one of the distal ends of the connector pins 216 when the connector 214 is attached to the right hand end of the housing body 200. Further in the assembly, the foil areas and the distal ends of the connector pins are conductively directly connected by soldering.

Among the circuitry borne by the circuit board 210 is a thermistor 226 which corresponds to the NTC temperature sensor described above. The thermistor 226 is located at the forward, or left hand, end of the board 210, on a protrusion 228 defined by the circuit board 210 and extending into the hollow smaller chamber defined within the threaded portion 202 of the housing 200.

The smaller of the circuit boards, i.e., circuit board 208, is hinged to the board 210 by the ribbon cable interconnection member 212. In assembly, this hinged circuit board 208 is folded over the larger circuit board 210, such that the circuit board 208 is parallel and closely located above the larger circuit board 210, as the boards are illustrated in FIG. 4*a*.

This entire assembly, carried on the channel rails 218,220, is then inserted into the larger chamber of the cylindrical housing 200. The thermistor, in this orientation, extends forward, i.e., leftward, into the smaller chamber within the threaded portion of the housing.

Highly thermal conductive potting compound is then poured into the housing containing the circuit boards. The potting compound holds both circuit boards rigidly fixed within the housing, and provides a path of low thermal resistance from the threaded portion of the housing to the thermistor.

Note that the channel rail 220 is shorter than the rail 218, in order to clear the ribbon cable 212, while still engaging a short portion of the lower edge of the board 210, as shown in FIG. 4A.

A shell portion 232 of the housing 200, having an edge 235, is crimped or rolled into a groove 234 which is molded into the connector housing for mechanical support and fastening of the connector to the housing body. A sealing O-ring 236 resides in a second groove of the connector.

The glow plug controller circuitry, contained within the housing which is in turn threaded in the engine block near a water jacket, utilizes direct engine mounting for facilitating temperature sensing of engine coolant temperature for enhancing accuracy in such temperature sensing and in the attendant glow plug control. The glow plug controller is contained within a structure which is sealed and impervious to contaminants. This structure supports the circuit boards in a compact and rigid fashion. The connector locates and holds the PC board in alignment during the assembly procedure, which allows the pins 216 to be soldered directly to the PC boards, rather than being interconnected to the PC boards with wire conductors.

While the preferred embodiment of the present invention has been described with some particularity, it to be understood that those or ordinary skill in the art may be able to make certain additions or modifications to, or deletions from, the embodiment described herein, without departing from the spirit of the scope or the invention, as set forth in the appended claims.

We claim:

1. A glow plug controller for a diesel engine having a block, said glow plug controller comprising:

a) a housing having a portion bearing external threads for mounting within a threaded recess of said block;

b) circuitry, including a temperature sensor and glow plug control circuitry for controlling glow plug operation as a function of a temperature sensed by the temperature sensor, said glow plug control circuitry and said temperature sensor disposed on a printed circuit board positioned within the housing and the temperature sensor being located within said threaded portion of said housing; and c) means for conductively coupling said glow plug control circuitry to other circuitry external to said housing.

2. The glow plug controller of claim 1, wherein:

glow plug controller circuitry is spaced apart from the temperature sensor on the printed circuit board.

3. The glow plug controller of claim 1, wherein:

said threaded portion is located proximate an end of said housing.

4. A glow plug controller for use in connection with a diesel engine having a block defining a recess, said glow plug controller comprising:

a) a generally tubular housing having an outer wall surface defining threads adapted for engaging said housing in said recess of said engine block;

b) a temperature sensor within said housing;

c) glow plug controller circuitry within said housing and being coupled to said temperature sensor for controlling glow plug operation as a function of a temperature sensed by the temperature sensor;

d) conductive coupling circuitry for conductively coupling said glow plug controller circuitry to circuitry external to said housing; and e) said temperature sensor and the glow plug controller circuitry mounted on a printed circuit board, the board supported within the tubular housing and configured such that the temperature sensor is located within a portion of said housing which is located within said recess when said housing is engaged in said recess by said threads.

5. A glow plug controller for a diesel engine, the glow plug controller comprising:

a) a housing having a portion adapted for fixed mounting within a recess in a block of the diesel engine;

b) circuitry, including a temperature sensor and glow plug controller circuitry for controlling glow plug operation as a function of a temperature sensed by the temperature sensor, said glow plug controller circuitry and the temperature sensor disposed on a printed circuit board positioned within the housing, the temperature sensor being located within said housing portion extending into the recess of said engine block; and c) means for conductively coupling said glow plug controller circuitry to other circuitry external to said housing.

6. The glow plug controller of claim 5, wherein:

said glow plug controller circuitry is spaced apart from the temperature sensor on the printed circuit board.

7. A glow plug controller comprising:

a) a housing comprising first and second interfitting parts and having a threaded portion adapted for mounting in a threaded recess of a diesel engine;

b) one of said parts defining structure including a pair of U-shaped channels for mounting thereon a printed circuit board and for holding said printed circuit board substantially fixed with respect to said one of said housing parts, and for maintaining said circuit board rigidly fixed within the housing formed by the interfitting of said two parts together; and c) circuitry, including a temperature sensor and glow plug controller circuitry for controlling glow plug operation as a function of a temperature sensed by the temperature sensor, said glow plug controller circuitry and the temperature sensor disposed on the printed circuit board, the temperature sensor being located within the threaded portion of the housing.

8. A glow plug controller for use in connection with a diesel engine having a block defining a jacket for engine coolant, said glow plug controller comprising:

a) a housing adapted for mounting in a recess of the engine block;

b) circuitry, including a temperature sensor and glow plug controller circuitry for controlling glow plug operation as a function of a temperature sensed by the temperature sensor, said glow plug controller circuitry and the temperature sensor being mounted on a printed circuit board disposed within the housing, the printed circuit board configured such that the temperature sensor is located within a portion of the housing extending into the recess of the engine block, the temperature sensor being thermally coupled to the exterior of said housing by a path of low thermal resistance; and c) means for coupling said glow plug controller circuitry to circuitry external to said housing.

* * * * *